US005845635A

United States Patent [19]

Hermansen et al.

[11] Patent Number: 5,845,635

[45] Date of Patent: Dec. 8, 1998

[54] SNORKEL WITH PIVOTING MOUTHPIECE

[75] Inventors: Frank Hermansen; Carl Winefordner, both of Corona Del Mar, Calif.

[73] Assignee: Q.D.S. Injection Molding, Inc., San Diego, Calif.

[21] Appl. No.: 986,674

[22] Filed: Dec. 8, 1997

[51] Int. Cl.[6] ..... B63C 11/16

[52] U.S. Cl. ..... 128/201.11; 128/201.27; 128/206.29

[58] Field of Search ..... 128/201.11, 201.27, 128/201.28, 206.29

[56] References Cited

U.S. PATENT DOCUMENTS 5,199,422 4/1993 Rasocha ..... 128/201.11
5,267,556 12/1993 Feng ..... 128/201.11

*Primary Examiner*—Aaron J. Lewis

*Attorney, Agent, or Firm*—Leonard Tachner

[57] ABSTRACT

A lower housing connects to the snorkel tube on one end, to the mouthpiece at the other, and can connect to ambient through a one-way purge valve in the middle. The lower housing has a mouthpiece with flexible bellows attached to it. Within the mouthpiece, and connected to the lower housing, is a sleeve in one of multiple positions. The mouthpiece is connected to the other end of the sleeve so that as the sleeve angle changes relative to the lower housing, so does the mouthpiece angle change.

A flexible rib in the lower housing has a raised contour that locks into one of a plurality of raised contours on the sleeve. Therefore, to change the angle of the mouthpiece relative to the lower housing, the snorkeler simply pushes the mouthpiece into one of several positions. There is enough locking pressure between the lower housing rib and the sleeve contours to prevent the mouthpiece from changing positions unintentionally.

8 Claims, 3 Drawing Sheets

SNORKEL WITH PIVOTING MOUTHPIECE

BACKGROUND OF THE INVENTION

1. Field of the Invention

The present invention relates generally to snorkel assemblies having a mouthpiece with some level of adjustability. The invention relates more specifically to a snorkel assembly having sufficient mouthpiece adjustability to prevent jaw fatigue while providing good airflow and reliable sealing.

2. Prior Art

Ergonomically, the conventional snorkel lacks suitability at the mouthpiece. For instance, the conventional mouthpiece is normally fixed on a rigid shaft or a corrugated flexible lower tube, both of which offer very little adjustment or none at all. Since the snorkel is attached to the mask-strap close to the ear, when the mouthpiece is put in the mouth, the angular difference between the ear and mouth leads to a deflection between the mouthpiece and the snorkel, and since the snorkel is fixed onto the mask-strap, this deflection tends to exist on the mouthpiece, generating a constant forceful deflection and disengagement from the mouth. The deflection is then compensated by the user who bites on the mouthpiece to keep it from coming out of the mouth.

An alternate mouthpiece involves one that rotates to-and-fro, also termed "swiveling". This type of mouthpiece eliminates some angular difference, but it cannot be adjusted to suit all types of face shapes and sizes, and so it is generally uncomfortable.

Another alternative design is a "ball joint" which is a universally adjustable joint between the snorkel tube and the lower housing which holds the mouthpiece. This solves the mouthpiece angle problem, but creates an airflow restriction and is difficult to reliably seal. The airflow restriction occurs because the area through the ball joint is ordinarily smaller than the area through the snorkel tube and because when the ball joint is in its extreme positions, the open area is partially obstructed. The difficulty in reliable sealing stems from a dynamic seal which is inherently more difficult to seal than a static seal and also because portions of the sealing surface are exposed to environmental elements including salt water, sand and silt.

Snorkeling time may be as long as 1 to 2 hours. During this time, if the snorkeler must constantly be biting on this mouthpiece, he or she will experience "jaw fatigue". If the snorkeler uses a snorkel with the ball joint design, he may experience fatigue from restricted breathing or leaking from a contaminated sealing surface. Clearly, the mouthpiece area on the conventional snorkel is an obvious drawback and one that warrants immediate correction.

The patent that appears to be most relevant to the invention is U.S. Pat. No. 5,267,556, *Snorkel with a Laterally Extended Downward Opening For Airflow Entry and a Universally Adjustable Mouthpiece.*

SUMMARY OF THE INVENTION

The invention effectively improves the prior art snorkel, eliminating the drawbacks mentioned above. These drawbacks relate primarily to undesirable jaw fatigue while maintaining good airflow and a reliable seal.

The present invention is characterized by a unique design at the lower end opening of the snorkel. A lower housing connects to the snorkel tube on one end, to the mouthpiece at the other, and can connect to ambient through a one-way purge valve in the middle. The lower housing has a mouthpiece with flexible bellows attached to it. Within the mouthpiece, and connected to the lower housing, is a sleeve in one of multiple positions. The mouthpiece is connected to the other end of the sleeve so that as the sleeve angle changes relative to the lower housing, so does the mouthpiece angle change.

A flexible rib in the lower housing has a raised contour that locks into one of a plurality of raised contours on the sleeve. Therefore, to change the angle of the mouthpiece relative to the lower housing, the snorkeler simply pushes the mouthpiece into one of several positions. There is enough locking pressure between the lower housing rib and the sleeve contours to prevent the mouthpiece from changing positions unintentionally.

Another advantage of the invention over those with a universal joint is that the air flow area is not less than a snorkel without this feature. Furthermore, as the mouthpiece is rotated across its range of positions, the breathing resistance is consistent because the air flow area through the lower housing remains relatively large.

Another advantage of this design over those with a universal joint is that there are not any additional seals compared to typical snorkels that have a separate mouthpiece. As with typical snorkels, the mouthpiece is a soft silicon or rubber material which stretches to fit over a flange of the hard lower housing thereby forming a static seal.

OBJECTS OF THE INVENTION

It is therefore a principal object of the present invention to provide a snorkel assembly having sufficient adjustability to prevent jaw fatigue and which maintains good airflow and reliable sealing.

It is another object of the invention to provide a snorkel assembly having an adjustable mouthpiece with locking whereby the mouthpiece may be adjusted to a comfortable position and then secured in that position to avoid inadvertent movement therefrom.

It is still an additional object of the invention to provide a snorkel assembly having a mouthpiece which is adjustable in angle relative to an elongated breathing tube of the snorkel assembly and which may be locked into any one of a plurality of angular positions to provide maximum comfort to the snorkeler.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
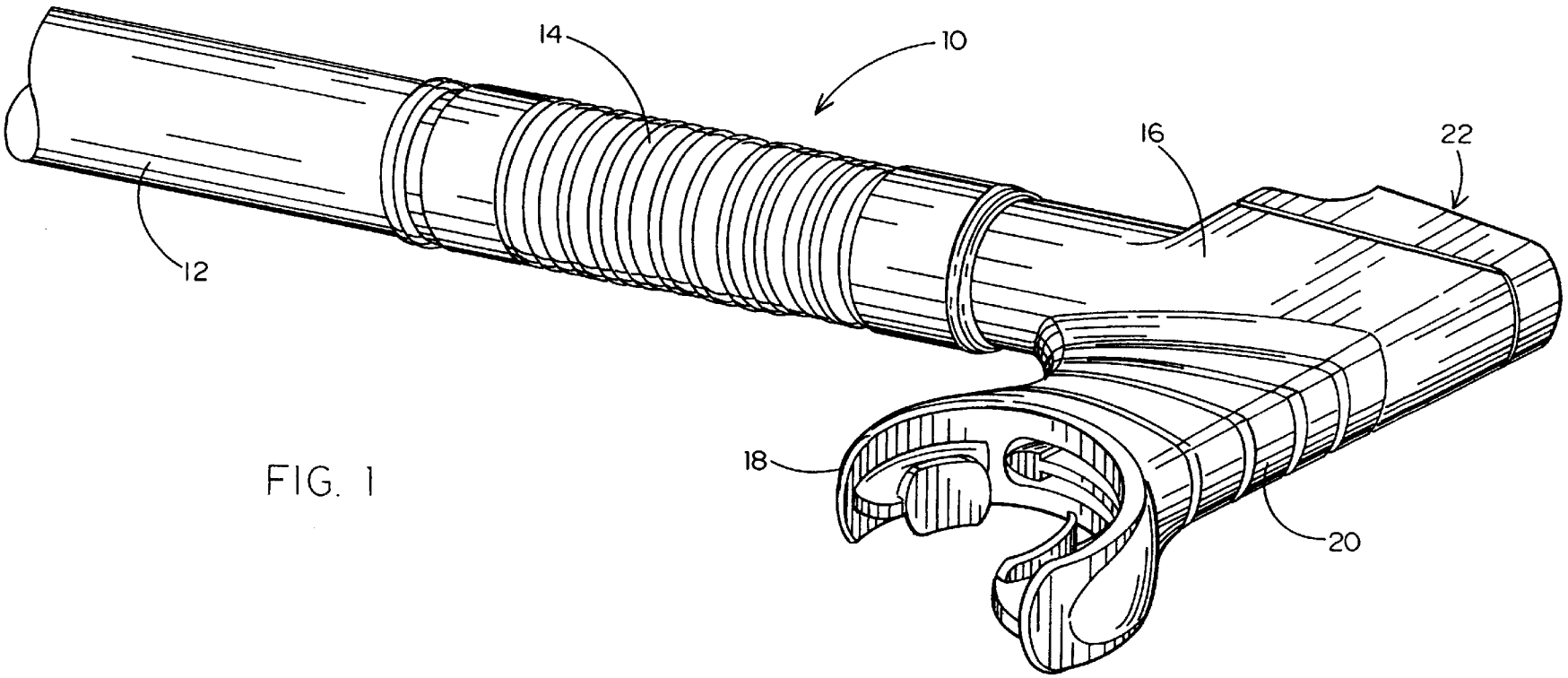
FIG. 1 is a perspective view of an entire snorkel assembly incorporating a preferred embodiment of the invention.

Referring to the accompanying figures, it will be seen that a snorkel 10 in accordance with a preferred embodiment of the invention, comprises a snorkel tube 12, a flexible tube member 14 and a mouthpiece section 16, the latter having a mouthpiece 18, a bellows-type housing 20 and a tubular portion 24.

Figure 2:
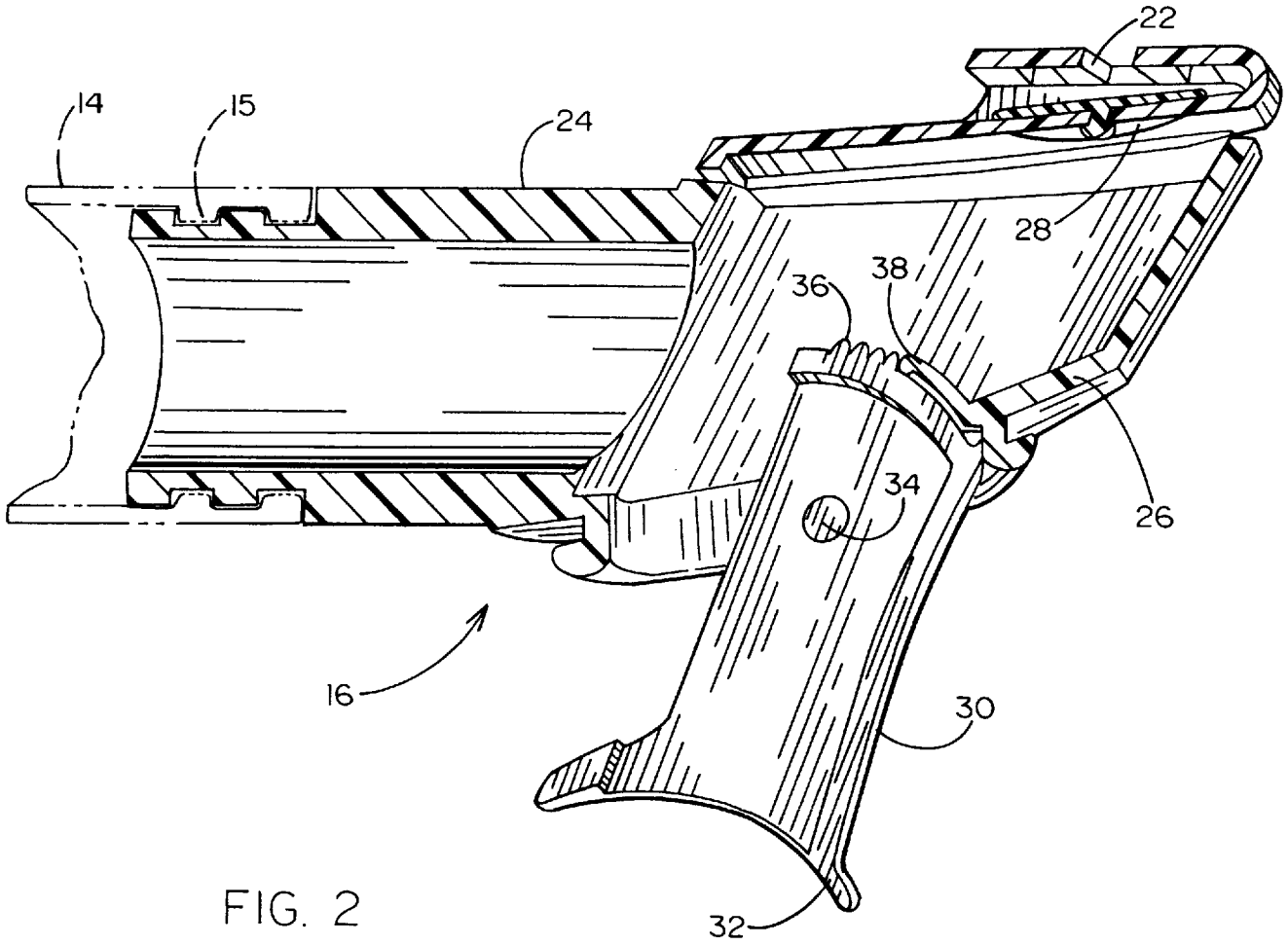
FIG. 2 is an enlarged view of the mouthpiece region of the snorkel assembly of FIG. 1.

The snorkel tube 12 may be a conventional, extended snorkel tube terminating in an upper opening (not shown) through which a snorkeler may draw in air when that opening is above water. The tube 12 may be connected in a conventional manner to the flexible tube member 14 to provide a degree of bendability in the snorkel 10. However, it will be understood that the invention is not in any way dependent on the presence or absence of flexible tube member 14. In fact, the present invention may be readily employed with a direct connection to an inflexible tube such as tube 12 of FIG. 1. In either case, mouthpiece section 16 is connected to the remaining portion or portions of the snorkel 10 by means of tubular portion 24 and one or more annular recesses 25 which mate with corresponding annular ridges 15 of member 14 as shown in phantom in FIG. 2.

Figure 3:
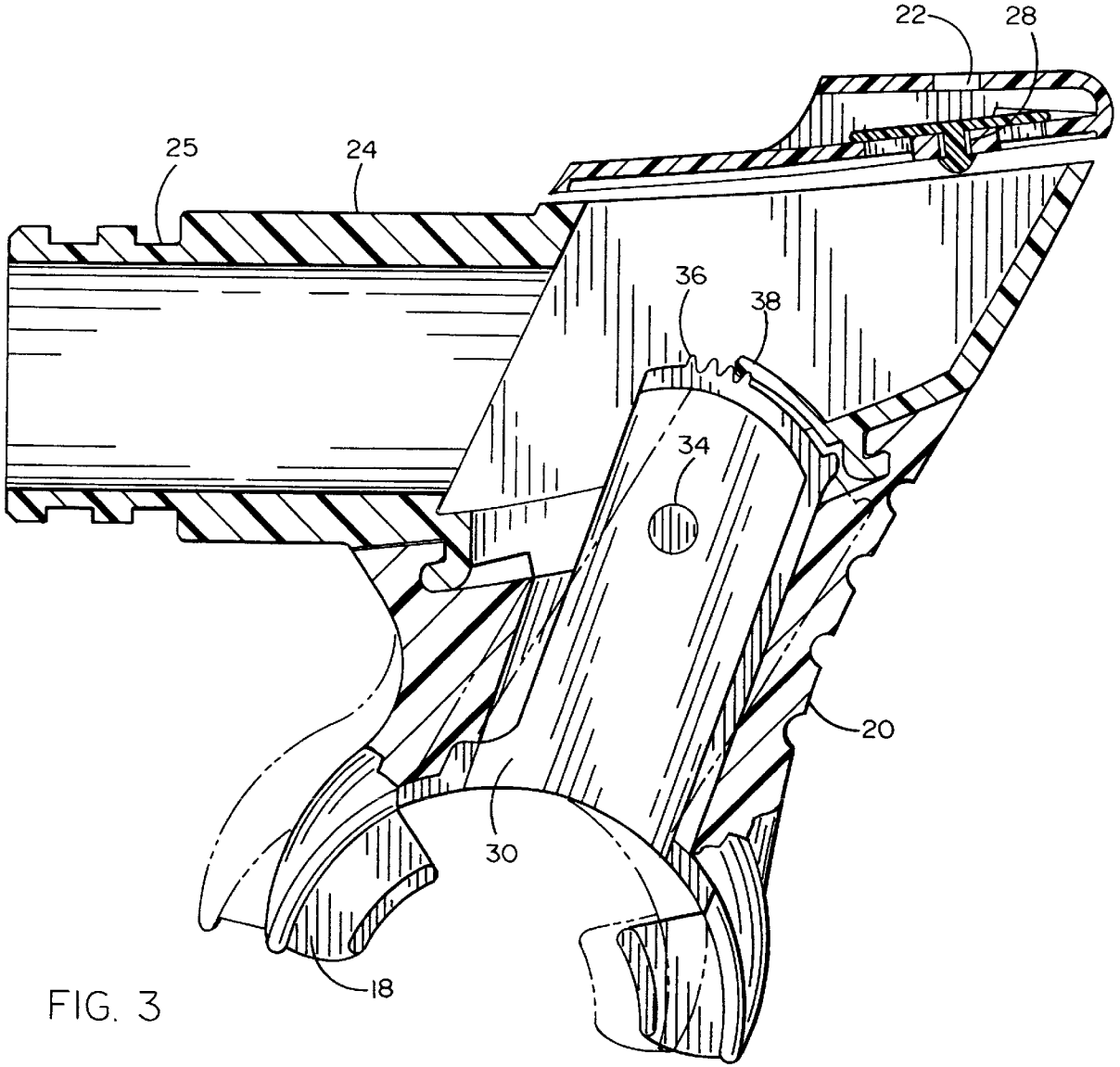
FIG. 3 is an enlarged view similar to that of FIG. 2, but illustrating the range of motion of the mouthpiece in the preferred embodiment.

Mouthpiece section 16 comprises a chamber 26, one side of which is sealed by a one-way valve 22 (having a mushroom flap 28) and the other side of which is in fluid communication with a mouthpiece holder 30. As seen best in FIG. 3, holder 30 supports a soft mouthpiece 18. Holder 30 provides a pair of wings 32 (see FIG. 2) to hold the mouthpiece. Moreover, the holder is surrounded by a ridged, rubber-like material forming a bellows-type housing 20, the purpose of which is to accommodate a limited amount of lateral adjustment of the mouthpiece 18 and holder 30 around a fulcrum point 34. Such adjustability is facilitated by a plurality of teeth 36 and a latch 38. The degree of adjustment provided in the preferred embodiment may be observed in FIG. 3 by virtue of the solid and phantom representations of mouthpiece 18.

Thus, it will be seen that the novel structure described herein, permits one to adjust the relative angle of the mouthpiece to the extension of the snorkel tube by simply rotating mouthpiece 18 and holder 30 around fulcrum 34 so that latch 38 engages a different one of the teeth 36.

Having thus described a preferred embodiment of the invention, it being understood that the disclosure is for purposes of illustrating an example of the invention and not limiting in regard to the scope of protection.

What we claim is:

1. In a snorkel having an elongated hollow tube having an opening at one end and being connected to a mouthpiece section at another end, an improved mouthpiece section comprising:

a mouthpiece holder;

a chamber;

a tubular member;

the tubular member having a first end connectible to said hollow tube and having a second end integral to and communicating with said chamber;

said mouthpiece holder being connected to said chamber at a fulcrum point and being rotatable relative to said chamber within a selected angular range; and a seal enclosing said chamber and said mouthpiece holder for preventing water leakage therebetween at all angles within the selected angular range between said mouthpiece holder and said chamber.

2. The improved mouthpiece section recited in claim 1, further comprising teeth on said mouthpiece holder and a levered latch on said chamber, the relative position of said teeth and said latch corresponding to a selected angle between said mouthpiece holder and said chamber and for substantially locking said mouthpiece holder and said chamber at said selected angle.

3. The improved mouthpiece section recited in claim 1, wherein said seal comprises a bellows-type housing.

4. The improved mouthpiece section recited in claim 1 further comprising a one-way valve in said chamber for draining water from said chamber.

5. A snorkel having an adjustable mouthpiece, the snorkel comprising:

a hollow snorkel tube and a mouthpiece section;

the mouthpiece section having the tubular member having a first end connectible to said hollow tube and having a second end integral to and communicating with a chamber;

a mouthpiece holder being connected to said chamber at a fulcrum point and being rotatable relative to said chamber within a selected angular range; and a seal enclosing said chamber and said mouthpiece holder for preventing water leakage therebetween at all angles within the selected angular range between said mouthpiece holder and said chamber.

6. The improved mouthpiece section recited in claim 5, further comprising teeth on said mouthpiece holder and a levered latch on said chamber, the relative position of said teeth and said latch corresponding to a selected angle between said mouthpiece holder and said chamber and for substantially locking said mouthpiece holder and said chamber at said selected angle.

7. The improved mouthpiece section recited in claim 5, wherein said seal comprises a bellows-type housing.

8. The improved mouthpiece section recited in claim 5 further comprising a one-way valve in said chamber for draining water from said chamber.

* * * * *